US005752430A

United States Patent [19]

Kawajiri et al.

[11] Patent Number: 5,752,430

[45] Date of Patent: May 19, 1998

[54] HIGH PRESSURE FUEL SUPPLY PUMP FOR ENGINE

[75] Inventors: Chiaki Kawajiri, Kariya; Yoshitsugu Inaguma, Oobu; Hiroshi Inoue, Chiryu, all of Japan

[73] Assignee: Denso Corporation, Kariya, Japan

[21] Appl. No.: 892,109

[22] Filed: Jul. 14, 1997

[30] Foreign Application Priority Data

Jul. 16, 1996 [JP] Japan ..... 8-185934

[51] Int. Cl.[6] ..... F16J 1/00

[52] U.S. Cl. ..... 92/129; 92/130 R; 417/471

[58] Field of Search ..... 92/129, 130 R, 92/140; 417/471

[56] References Cited

U.S. PATENT DOCUMENTS

| | | | |
|---|---|---|---|
| 2,322,356 | 6/1943 | Hahn | 92/129 |
| 2,678,005 | 5/1954 | Messick | 92/129 |
| 3,067,728 | 12/1962 | Bordini | 92/129 |
| 4,519,299 | 5/1985 | Moloneu | 92/130 R |
| 5,415,535 | 5/1995 | Egger et al. | 417/471 |
| 5,603,303 | 2/1997 | Okajima et al. . | |

FOREIGN PATENT DOCUMENTS

| | | | |
|---|---|---|---|
| 6-229369 | 8/1994 | Japan . | |
| 681237 | 8/1979 | U.S.S.R. | 92/129 |

*Primary Examiner*—Thomas E. Denion
*Attorney, Agent, or Firm*—Nixon & Vanderhye P.C.

[57] ABSTRACT

A high pressure fuel supply pump which is driven by a cam connected to an engine is composed of a cylinder, a plunger slidably disposed in the cylinder, a tappet linked to the cam, a coil spring biasing the tappet against the cam, a cylindrical guide for the tappet, a plate member in abutment with head portion of the plunger, and a plurality of balls disposed between the plate member and the tappet to be slidable in directions perpendicular to the reciprocating motion of the plunger. Each of the balls shares the stress applied from the tappet.

7 Claims, 6 Drawing Sheets

HIGH PRESSURE FUEL SUPPLY PUMP FOR ENGINE

BACKGROUND OF THE INVENTION

1. Field of the Invention

The present invention relates to a pump for supplying high pressure fuel to an engine.

2. Description of the Related Art

JPA 6-229369 discloses a fuel supply pump which has a fuel inlet and a fuel outlet at the top thereof, and a cylinder and plunger. The base portion of the plunger is connected to a reciprocating member via a plate member, a slider and a ball. The slider is disposed to move in directions perpendicular to the reciprocating direction of the reciprocating member. This structure prevents transverse or shearing force applied to the plunger even if the plunger happens to be out of alignment with the cylinder and also renders assembling of the pump easy.

However, because the reciprocating motion of the pump is transmitted through the single ball to the plunger, an excessive stress may be applied to the ball if high pressure fuel is to be supplied. If a transverse force is applied to the reciprocating member by a cam follower and a cam, the reciprocating member is inclined, thereby increasing frictional losses between the reciprocating member and the plate member, between the plate member and the slider, between the slide and ball and between the ball and the plunger. As a result, the plunger and the cylinder may be burned together.

SUMMARY OF THE INVENTION

The present invention has an object of providing a high pressure fuel supply pump in which the frictional losses are substantially reduced.

Another object of the present invention is to provide a high pressure fuel supply pump which has an increased strength in the surfaces for transmitting the reciprocating motion.

Another object of the present invention is to provide a high pressure fuel supply pump which is free from the burning of the plunger and the cylinder.

According to a main feature of the present invention, a high pressure fuel supply pump driven by a cam comprises a cylinder, a plunger slidably disposed in the cylinder, a tappet linked to the cam, a spring for biasing the tappet against the cam, a cylindrical guide of the tappet, a plate member in abutment with the head portion of the plunger, and a plurality of balls disposed between the plate member and the tappet. Therefore, each of the balls shares the stress applied thereto from the cam and slides in directions perpendicular to the reciprocating motion of the plunger.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

(First Embodiment)

Figure 1:
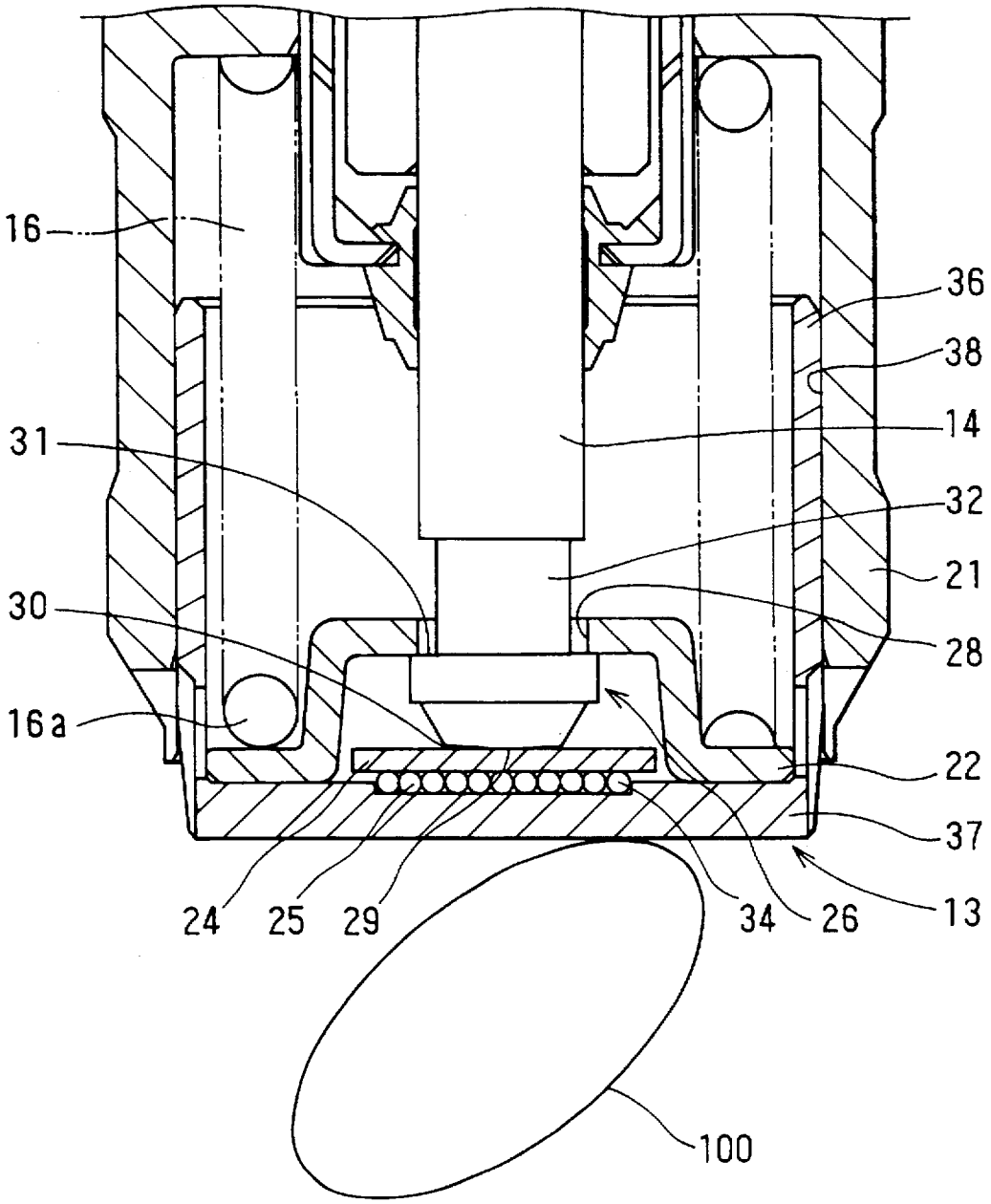
FIG. 1 is a cross sectional side view illustrating a main portion of a high pressure fuel supply pump according to a first embodiment.
Figure 2:
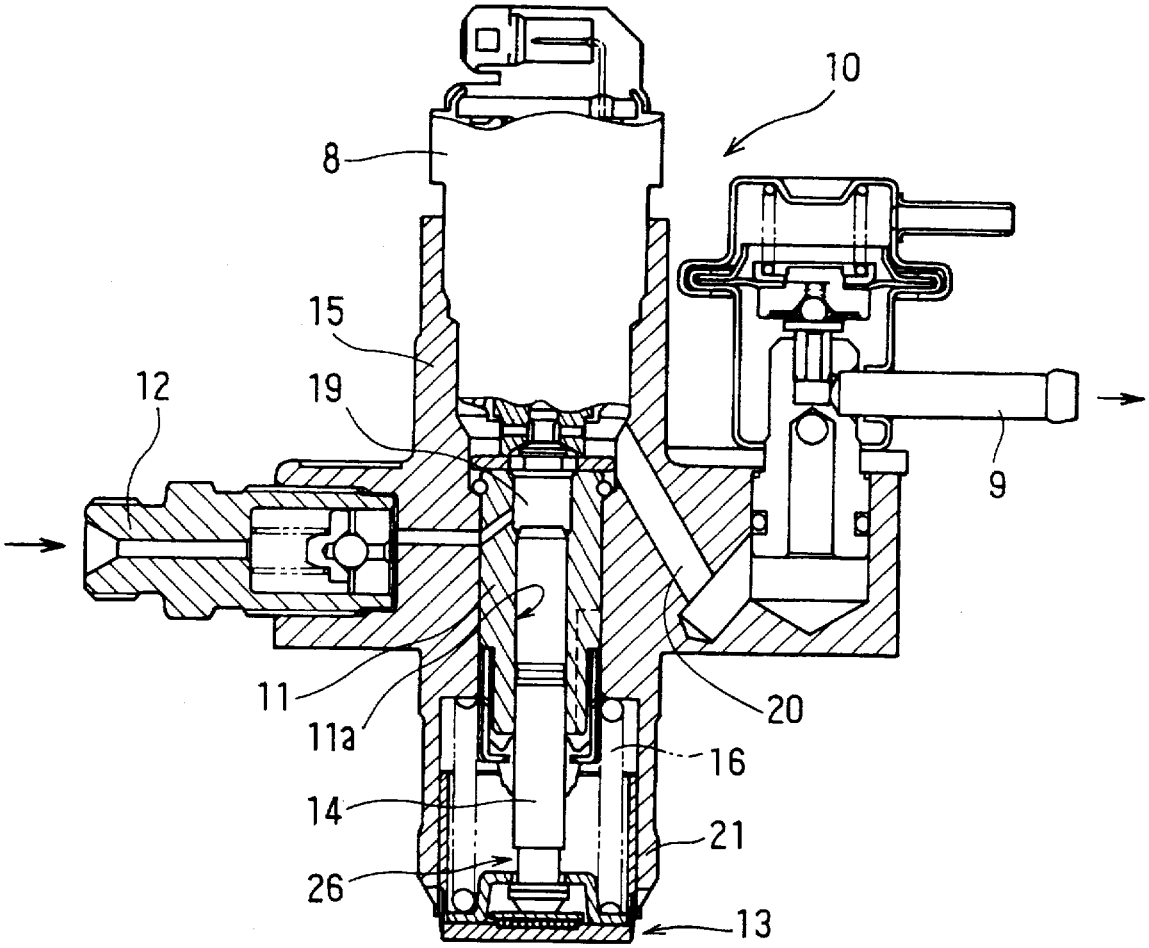
FIG. 2 is a cross-sectional view of the entire high pressure fuel supply pump according to the first embodiment.

A first embodiment is described with reference to FIGS. 1 and 2. A high pressure fuel supply pump 10 takes fuel from a fuel inlet 12 into a plunger chamber 19. The fuel in the chamber 19 is pressurized by a plunger 14 and discharged through a fuel outlet 9 when an electromagnetic valve 8 opens the fuel passage between the plunger chamber 19 and the fuel outlet 9. The fuel is not discharged when the electromagnetic valve 8 closes. The plunger 14 is slidably disposed in a cylinder bore 11*a* of a cylinder 11. The plunger chamber 19 is defined by the upper end of the plunger 14, the cylinder bore 11*a* and the lower end of the electromagnetic valve 8.

A connecting member 26 is integrally formed at the lower end of the plunger 14 and disposed in abutment with a plate member 24. The lower surface of the plate member 24 engages with a tappet 13 through a plurality of balls 25. The lower end of 16*a* of a compressive coil spring 16 is seated on a spring seat member 22, which is seated on the upper side a bottom portion 37 of the tappet 13.

The plunger 14 is reciprocated by the cam 100, which is connected to an engine valve cam shaft (not shown), via the tappet 13 to take the fuel into the plunger chamber 19 and discharge it from the plunger chamber 19 in response to on-off operation of the electromagnetic valve 8.

The connecting member 26 has a neck portion 32 and a head portion 33. The head portion 32 has a contact surface 29 formed perpendicular to the axis of the plunger 14 and a annular chamber 30 formed around the contact surface. The contact surface 29 is in contact with the plate member 24 and will not leave the plate member 24 even if the tappet 13 is inclined due to the operation of the cam 100. The spring seat 22 has a center hole 28, through which the neck portion 32 of the connecting member 26 extends. Therefore, when the spring 16 expands to return the plunger 14 downward, a shoulder portion 31 formed on the connecting member 26 is pushed by the spring seat 22. On the other hand, when the plunger 14 is seated on the spring seat, a gap is formed between the spring seat 22 and the shoulder portion 31. When the plunger 14 is lifted from the spring seat 22, the gap prevents the plunger 14 from being twisted by the coil spring 16 until the gap is closed.

Since the plate 14 is disposed on the balls 25, it can move in directions parallel with the tappet 13. The tappet 13 has a recess 34 at the center thereof to hold the balls 25. Since the reciprocating force is transmitted from the cam 100 to the plunger through a plurality of balls 25 each of which shares a part of the reciprocating force, no excessive stress is applied to the balls or any other portions.

The tappet has a cylindrical portion 36 in addition to the bottom portion 37. The cylindrical portion 36 is fitted slidably to the inner periphery of a guiding sleeve 21 which is fixed to the engine head.

The cam 100 is in contact with the back surface of the bottom portion 37. When the cam 100 rotates, the tappet 13 reciprocates and drives the plunger 14. When the plunger 14 is lifted, the friction between the tappet 13 and the plunger 14 is limited to the rolling frictions between the plate member 24 and the balls 34 and between the balls 34 and the bottom portion 37 of the tappet 13. While the plunger 14 is returning to the plate member 24, the tappet 13 is twisted by the coil spring 16. Accordingly, the tappet 13 and the sleeve 21 are not burned together easily.

(Second Embodiment)

Figure 3:
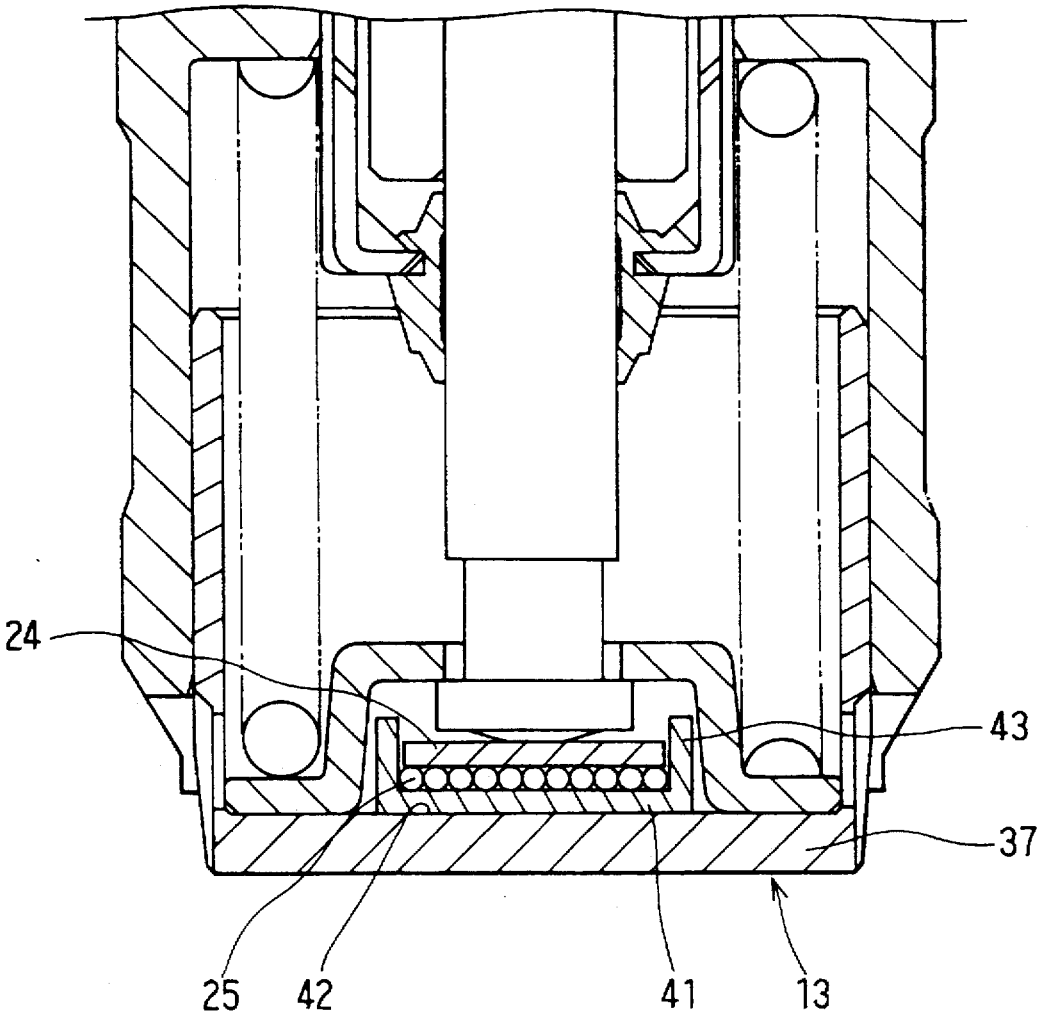
FIG. 3 is a cross sectional side view illustrating a main portion of a high pressure fuel supply pump according to a second embodiment.

A high pressure fuel supply pump according to a second embodiment is described with reference to FIG. 3, in which a ball case 41 having a circular flange 43 is disposed on a flat portion 42 of the bottom portion 37 of tappet 13. The recess 34 of bottom portion 37 of the first embodiment is omitted. Other portions are substantially the same as those of the first embodiment.

Since the ball case 41 holds the balls, assembling of the pump is easier than the first embodiment.

(Third Embodiment)

Figure 4:
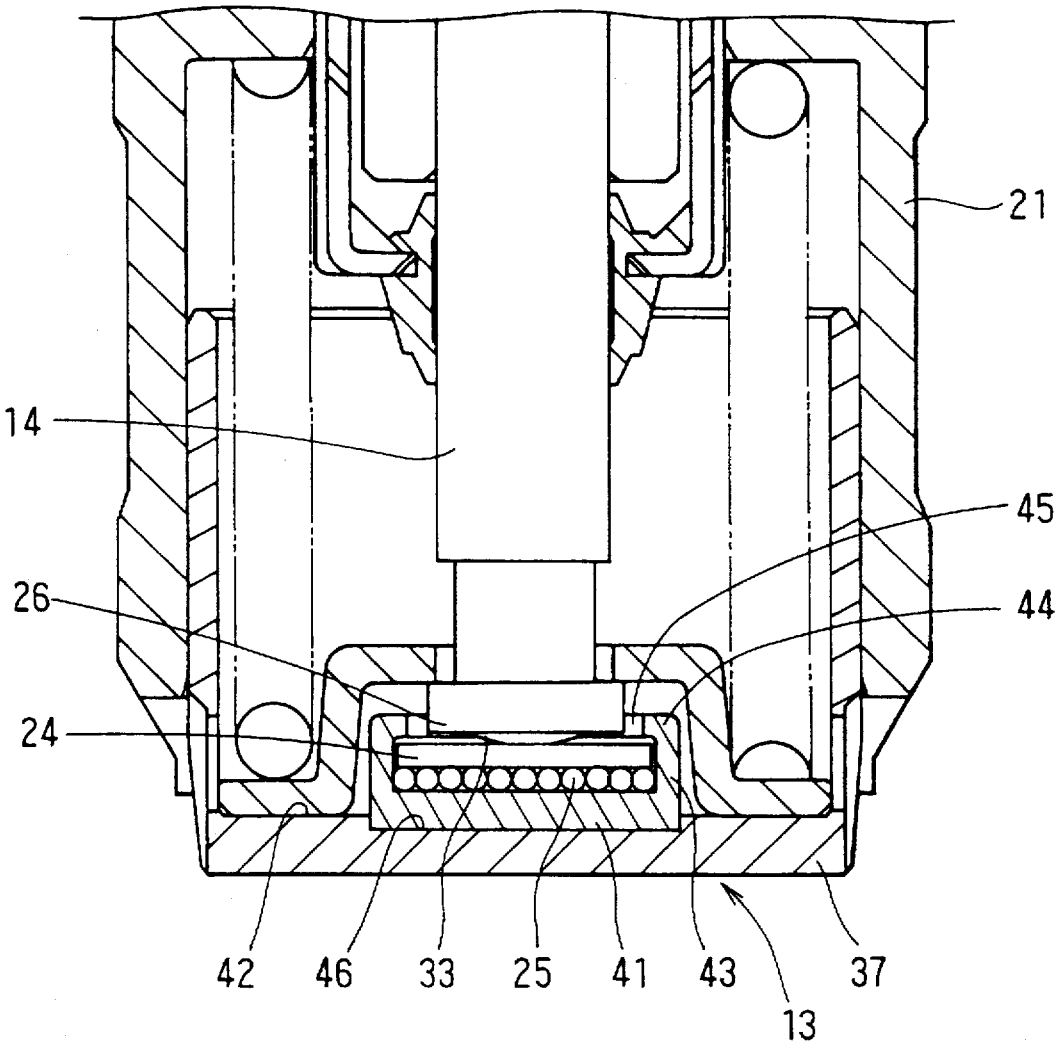
FIG. 4 is a cross sectional side view illustrating a main portion of a high pressure fuel supply pump according to a third embodiment.

A high pressure fuel pump according to a third embodiment is described with reference to FIG. 4. The ball case 41 has a brim 44 at the upper end of the circular flange 43, which holds the plate member in the case 41 and surrounds the head portion 33 of the connecting member 26 at a distance sufficient to pass the head portion 33. The tappet's bottom portion 37 has a recess 46 to have the bottom portion of the ball case 41.

Before the pump is assembled, the balls 25 and the plate member 24 are mounted in the case 41, which is placed in the recess 46 of the tappet's bottom portion 37. This renders the assembling easy.

(Fourth Embodiment)

Figure 5:
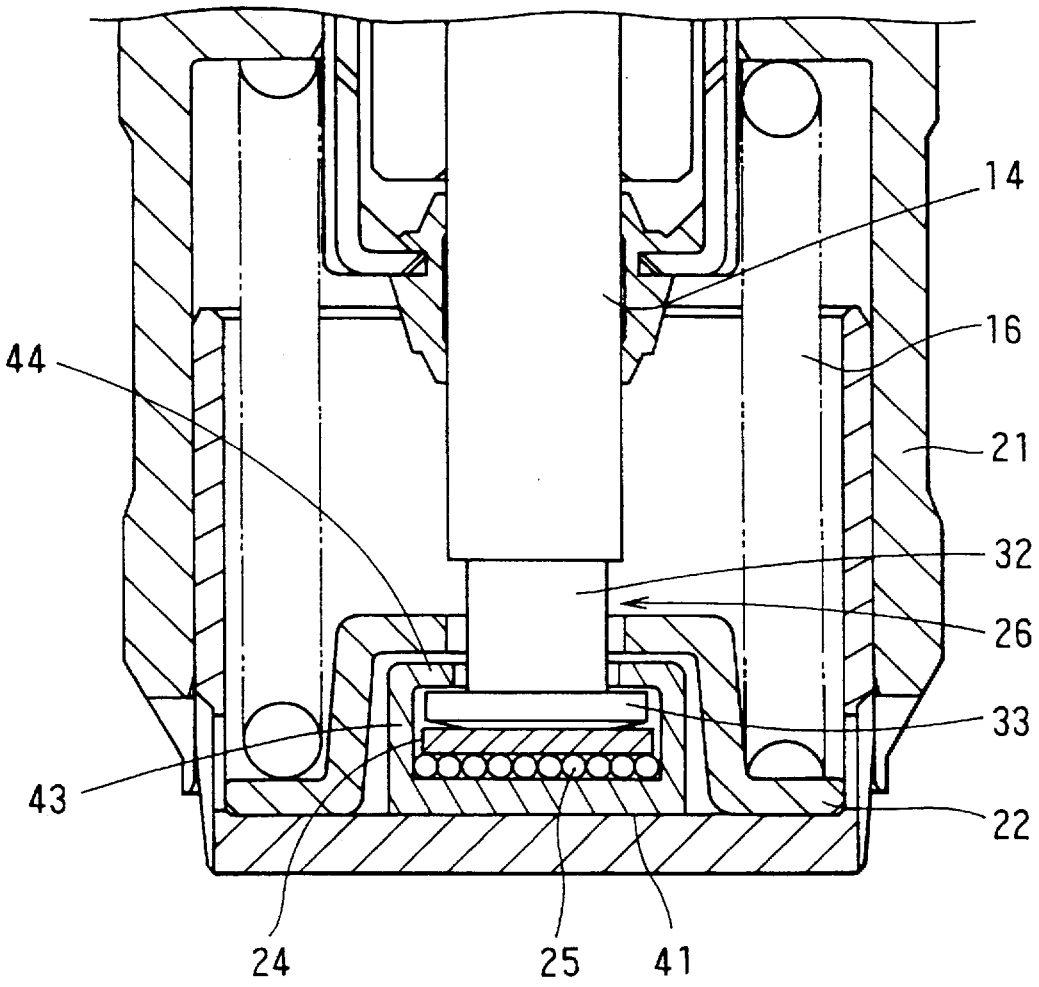
FIG. 5 is a cross sectional side view illustrating a main portion of a high pressure fuel supply pump according to a fourth embodiment.

A high pressure fuel supply pump according to a fourth embodiment is described with reference to FIG. 5.

The head portion 33 of the connecting member 26 is held in the ball case 41 together with the balls and the plate member 24.

Before the plunger 14 is assembled into the pump, the plunger 14 is inserted into the center hole of the spring seat 22. Then, the head portion 33 is put in the ball case 41 together with the plate member 24 and the balls 25, and the brim 44 is bent to hold the head portion 33.

(Fifth Embodiment)

Figure 6:
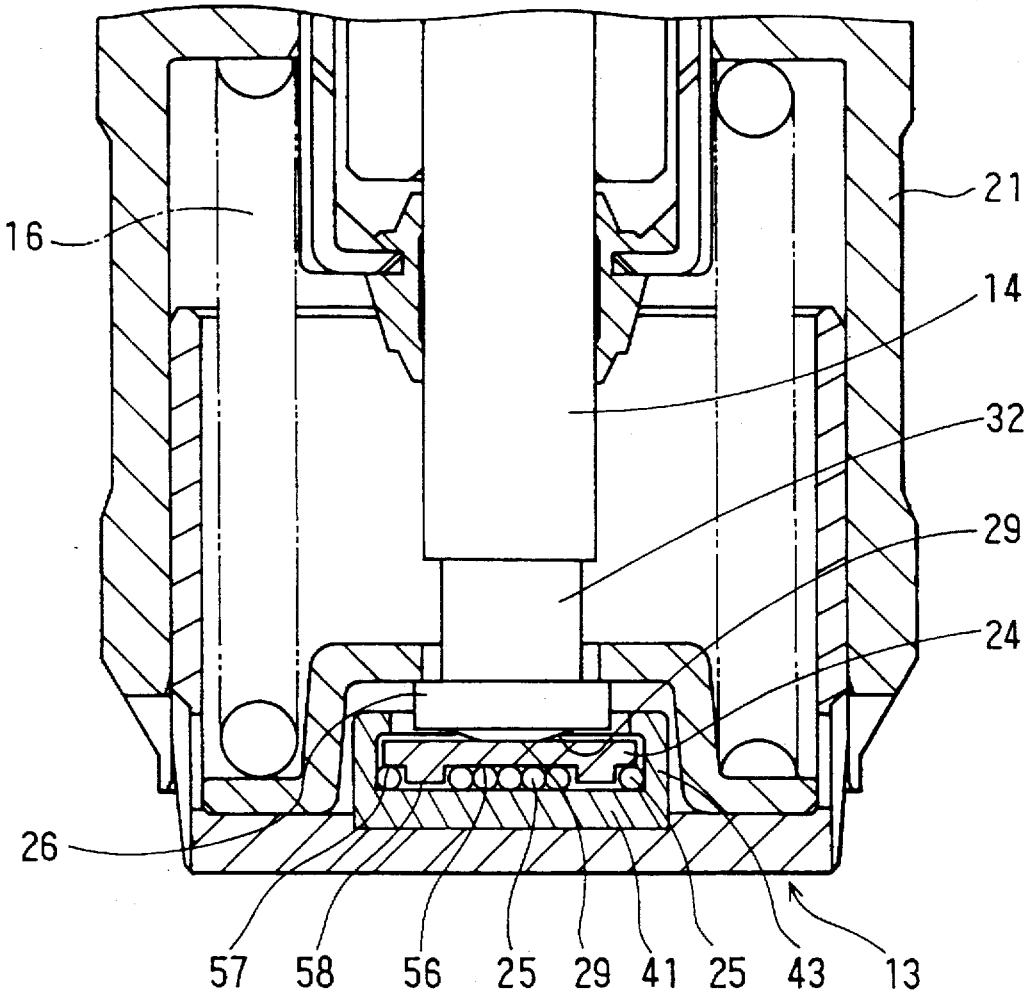
FIG. 6 is a cross sectional side view illustrating a main portion of a high pressure fuel supply pump according to a fifth embodiment.

A high pressure fuel supply pump according to a fifth embodiment is described with reference to FIG. 6.

The plate 24 has a central recess 56 in which a plurality of balls 25 are retained to receive the reciprocating force driving force and a circumferential recess 57 in which a plurality of balls 25 are retained to receive the twisting force or radial force. Accordingly, the plate member 24 is prevented from contacting the inner surface of the circular flange 43. That is, the friction in the direction perpendicular to the plunge axis is limited to the rolling friction of the balls.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A high pressure fuel supply pump driven by a cam comprising:

a cylinder having a center hole;

a plunger slidably disposed in said center hole, said plunger having a neck portion and a head portion;

a tappet disposed to be linked to said cam for transmitting reciprocating motion from said cam;

a spring for biasing said tappet against said cam;

a cylindrical guide for guiding reciprocal motion of said tappet;

a plate member disposed in abutment with said head portion; and a plurality of balls disposed between said plate member and said tappet to be slidable in directions perpendicular to said reciprocating motion; wherein each of said balls receives a part of said reciprocating motion from said tappet.

2. A high pressure fuel supply pump as claimed in claim 1 further comprising a spring seat disposed between said spring and said tappet, wherein said spring comprises a coil spring having one end seated on said spring seat, said spring seat has a center hole the size of which is larger than the outer size of said neck portion and smaller than the size of said head portion.

3. A high pressure fuel supply pump as claimed in claim 2 further comprising a case for holding said balls and said plate member between said head portion and said tappet.

4. A high pressure fuel supply pump as claimed in claim 1, wherein said tappet has a recess for receiving said case.

5. A high pressure fuel supply pump as claimed in claim 3, wherein said case has a flange for radially holding said balls and said plate.

6. A high pressure fuel supply pump as claimed in claim 5, wherein said case has a brim extending radially inward from said flange for axially holding said balls and said plate.

7. A high pressure fuel supply pump as claimed in claim 3, wherein said plate member has a central recess for holding a number of said balls and a circumferential recess for holding the remainder of said balls.

* * * * *